US011724302B2

(12) United States Patent
Meador

(10) Patent No.: US 11,724,302 B2
(45) **Date of Patent: *Aug. 15, 2023**

(54) METHOD AND APPARATUS FOR CAN EXPANSION

(71) Applicant: BELVAC PRODUCTION MACHINERY, INC., Lynchburg, VA (US)

(72) Inventor: Gerald Meador, Hardy, VA (US)

(73) Assignee: BELVAC PRODUCTION MACHINERY, INC., Lynchburg, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/578,160

(22) Filed: Jan. 18, 2022

(65) Prior Publication Data

US 2022/0203430 A1 Jun. 30, 2022

Related U.S. Application Data

(63) Continuation of application No. 15/755,570, filed as application No. PCT/US2016/049469 on Aug. 30, 2016, now Pat. No. 11,253,904.

(Continued)

(51) Int. Cl.
*B21D 41/02* (2006.01)
*B21D 51/26* (2006.01)

(52) U.S. Cl.
CPC ..... *B21D 41/02* (2013.01); *B21D 41/026* (2013.01); *B21D 51/2669* (2013.01)

(58) Field of Classification Search
CPC .... B21D 41/02; B21D 41/021; B21D 41/025; B21D 41/026; B21D 41/028; B21D 51/2669; B21D 39/20; B21D 39/08
See application file for complete search history.

(56) References Cited

U.S. PATENT DOCUMENTS 1,264,519 A 4/1918 Hinson
3,164,045 A 1/1965 Lee
(Continued)

FOREIGN PATENT DOCUMENTS

JP S51-030841 3/1976
JP S60-24426 2/1985
(Continued)

OTHER PUBLICATIONS

Office Action in Japanese Patent Application No. JP 2018-530654, dated Jun. 15, 2020 (2 pages).
(Continued)

*Primary Examiner* — Debra M Sullivan
(74) *Attorney, Agent, or Firm* — Nixon Peabody LLP

(57) ABSTRACT

An expansion tool for expanding an article. The expansion tool includes a lead-in portion extending outwardly from a first end of the expansion tool and a first pilot portion extending from the lead-in portion. The first pilot portion has a first diameter. The expansion tool further includes a second pilot portion being generally parallel with the first pilot portion. The second pilot portion has a second diameter larger than the first diameter. The expansion tool further includes a forming portion bridging the first pilot portion and the second pilot portion. The forming portion is generally sloped. The expansion tool further includes an expansion portion extending from the second pilot portion toward a second end of the expansion tool. The expansion portion has a third diameter larger than the second diameter.

16 Claims, 6 Drawing Sheets

Related U.S. Application Data

(60) Provisional application No. 62/212,748, filed on Sep. 1, 2015.

(56) References Cited

U.S. PATENT DOCUMENTS

| | | | | |
|---|---|---|---|---|
| 3,304,762 | A | 2/1967 | Ray | |
| 3,504,515 | A | 4/1970 | Reardon | |
| 4,161,112 | A | 7/1979 | Stump | |
| 7,578,161 | B1 | 8/2009 | Sizemore | |
| 7,788,957 | B2 | 9/2010 | Okui | |
| 7,963,139 | B2 | 6/2011 | Shortridge | |
| 9,700,929 | B2 | 7/2017 | Fedusa | |
| 10,052,672 | B1 | 8/2018 | Boudwin | |
| 2010/0011833 | A1 | 1/2010 | Sizemore | |
| 2013/0160517 | A1* | 6/2013 | Fedusa | B21D 51/2623 72/372 |
| 2015/0082849 | A1 | 3/2015 | Babbitt | |

FOREIGN PATENT DOCUMENTS

| | | | |
|---|---|---|---|
| JP | S63-183738 | A | 7/1988 |
| JP | H05-212470 | A | 8/1993 |
| JP | H07-124670 | A | 5/1995 |
| JP | 2006-130558 | | 5/2006 |
| JP | 2015-506842 | | 3/2015 |
| WO | WO 2006/033376 | A1 | 3/2006 |
| WO | WO 2008/002741 | A1 | 1/2008 |
| WO | WO 2011/016434 | A1 | 2/2011 |

OTHER PUBLICATIONS

International Search Report from International Application No. PCT/US2016/049469 dated Nov. 22, 2016.

First Examination Report in Australian Patent Application No. AU 2016317015, dated Jan. 29, 2021 (4 pages).

Office Action in Chinese Patent Application No. CN 201680046934.6, dated Dec. 13, 2018 (9 pages).

Communication Pursuant to Article 94(3) EPC in European Patent Application No. EP 16763427.8, dated Oct. 12, 2020 (6 pages).

Notice of Allowance in Japanese Patent Appliation No. JP 2018-530654, dated Oct. 26, 2020 (3 pages).

International Preliminary Report on Patentability in International Application No. PCT/US2016/049469, dated Mar. 15, 2018 (8 pages).

* cited by examiner

METHOD AND APPARATUS FOR CAN EXPANSION

CROSS-REFERENCE TO RELATED APPLICATIONS

The application is a continuation U.S. patent application Ser. No. 15/755,570, filed Feb. 27, 2018, which is a U.S. National Stage of International Application No. PCT/US2020/049469 which claims priority to and benefit of U.S. Provisional Patent Application No. 62/212,748, filed Sep. 1, 2015, all of which are hereby incorporated by reference herein in their entireties.

TECHNICAL FIELD

The present invention relates generally to the field of article expansion mechanisms. More specifically, the invention relates to an apparatus and method for expanding an article, such as a beverage container or can.

BACKGROUND

In the industry, beverage containers for various soft drinks and/or beer are produced in large quantities and relatively economically to substantially an identical shape. There is an increasing desire among beverage manufacturers to sell products from economical containers having unique configurations to assist in differentiating their products from their competitors.

Conventional beverage containers are generally formed from a metal cylinder made from aluminum alloy sheet, surface-treated steel, a combination thereof, or the like. The metal cylinder typically undergoes multiple expansion iterations. The expansion iterations are used to expand the body of the container, thereby thinning the metal material such that less metal material is used. As such, the container is generally less costly to manufacture. Multiple iterations may also be used to form an expanded portion of the container, such as in a bottle-shaped container configuration.

Conventional methods for expanding a container generally include forcing an expander tool or expansion tool with an outside diameter that is larger than the inside diameter of the container inside the container. The expansion is generally regulated by the size and geometry of the expander tool. The expander tool may have an angle on the nose of the tool (e.g., a "pilot") to guide the container, followed by an expanding portion that performs the expansion. Expansions without piloting may lead to an uneven forming, causing the formed portion of the container to be off center and/or causing thinning to take place on one side wall of the container, which may lead to splitting.

It is an object of the invention to have an apparatus that can expand an article, such as a beverage container or can, that increases efficiencies of expansion processes, minimizes processing time requirements, and/or produces uniform containers with minimal defects.

SUMMARY

According to one aspect, an expansion tool for expanding an article is disclosed. The expansion tool includes a lead-in portion extending outwardly from a first end of the expansion tool and a first pilot portion extending from the lead-in portion. The first pilot portion has a first diameter. The expansion tool further includes a second pilot portion being generally parallel with the first pilot portion. The second pilot portion has a second diameter larger than the first diameter. The expansion tool further includes a forming portion bridging the first pilot portion and the second pilot portion. The forming portion is generally sloped. The expansion tool further includes an expansion portion extending from the second pilot portion toward a second end of the expansion tool. The expansion portion has a third diameter larger than the second diameter.

According to another embodiment described herein, an expansion mechanism for expanding an article is disclosed. The expansion mechanism includes a first expansion tool including a first lead-in portion extending outwardly from a first end of the first expansion tool and a first pilot portion extending from the first lead-in portion. The first pilot portion has a first diameter. The first expansion tool further includes a first expansion portion. The first expansion portion has a second diameter. The second diameter is larger than the first diameter. The first expansion tool further includes a first land bridging the first pilot portion and the first expansion portion. The expansion mechanism further includes a second expansion tool including a second lead-in portion extending outwardly from a first end of the second expansion tool and a second pilot portion extending from the second lead-in portion. The second pilot portion has a third diameter. The second expansion tool further includes a third pilot portion being generally parallel to the second pilot portion. The third pilot portion has a fourth diameter. The fourth diameter is larger than the third diameter. The second expansion tool further includes a forming portion bridging the second pilot portion and the third pilot portion and a second expansion portion having a fifth diameter. The fifth diameter is larger than the third diameter. The second expansion portion includes a second land bridging the forming portion and the second expansion portion. The axial distance from the first end of the first expansion tool to the first land is generally the same as the axial distance from the first end of the second expansion tool to the forming portion. The second expansion tool is configured to be used subsequent to the first expansion tool.

According to one process described herein, a method of expanding an article is disclosed. The method includes inserting a first end of a first expansion tool into an open end of the article. The first expansion tool has a first pilot portion followed by a first expansion portion. The first pilot portion has a first diameter generally equal to an initial diameter of the container. The first expansion portion has a second diameter. The second diameter is greater than the first diameter. The first expanded portion forms a partially expanded container having an expanded portion. The method further includes inserting a first end of a second expansion tool into the open end of the partially expanded container. The second expansion tool includes a second pilot portion having a third diameter and a third pilot portion having a fourth diameter. The fourth diameter is generally equal to the second diameter and greater than the third diameter. The second expansion tool further includes a first forming portion bridging the second and third pilot portions. The first forming portion is generally sloped. The second expansion tool further includes a second expansion portion extending from the third pilot portion. The second expansion portion has a fifth diameter. The fifth diameter is greater than the second diameter. The forming portion smooths at least one deformity formed in the expanded portion of the container by the first expansion tool.

Still other aspects, features, and advantages of the present invention are readily apparent from the following detailed description, by illustrating a number of exemplary embodiments and implementations. The present invention is also capable of other and different embodiments, and its several details can be modified in various respects, all without departing from the spirit and scope of the present invention. Accordingly, the drawings and descriptions are to be regarded as illustrative in nature and not as restrictive. The invention is to cover all modifications, equivalents, and alternatives falling within the spirit and scope of the invention.

BRIEF DESCRIPTION OF THE DRAWINGS

Exemplary embodiments are illustrated in referenced figures. It is intended that the embodiments and figures disclosed herein are to be considered illustrative rather than restrictive.

Figure 1A:
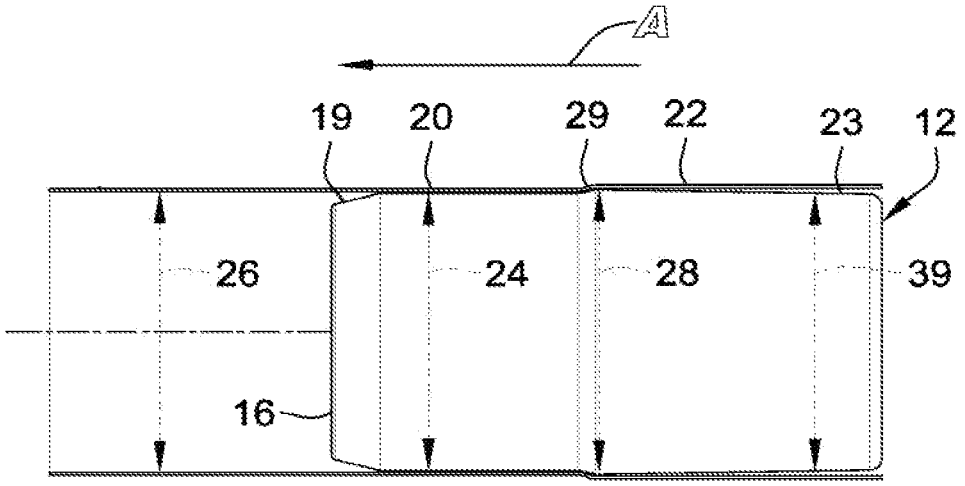
FIG. 1A is a side view of an expansion operation being performed on a container using a first expansion tool.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATED EMBODIMENTS

Existing expansion processes and apparatus suffer from a number of significant limitations. In particular, for example, expansion tools used in conventional expansion processes often have limited piloting. Lack of sufficient piloting often provides inadequate guiding of an article or container during expansion operations, thereby causing the container to be off-center relative to the expansion tool, which may lead to uneven forming, undesirable thinning or even splitting of a portion of the container material, or the like.

According to aspects of the present disclosure, apparatus and methods are described for improving article (e.g., container) expansion processes. Articles formed using the embodiments described herein may have an expanded portion formed by an expanded portion of an expansion tool. The expanded portion may have a greater diameter than, e.g, the unexpanded portion of the article.

The articles described herein may be a can, any suitable food or beverage container, jar, bottle or any other suitable article. The article has an open end opposite a closed end and a sidewall extending from the closed end. Alternatively, the article may be open at both ends. A top, lid, or other closure can be added to the article after the expansion process.

For exemplary purposes only, the below description will describe the expansion apparatus and methods for use on a container. It will be recognized that the methods and apparatus described herein may be used with any suitable article.

According to the embodiments described herein, an expansion mechanism includes two or more expansion tools in which there is constant piloting, or guiding, during each expansion such that the expansion tool remains generally centralized within the container. As such, uneven expansion/forming, undesirable/uneven thinning, splitting, bulges, and the like may be minimized.

According to one embodiment, an expansion tool for expanding an article includes a lead-in portion extending outwardly from a first end of the expansion tool and a first pilot portion extending from the lead-in portion. The first pilot portion has a first diameter. The expansion tool further includes a second pilot portion being generally parallel with the first pilot portion. The second pilot portion has a second diameter larger than the first diameter. The expansion tool further includes a forming portion bridging the first pilot portion and the second pilot portion. The forming portion is generally sloped. The expansion tool further includes an expansion portion extending from the second pilot portion toward a second end of the expansion tool. The expansion portion has a third diameter larger than the second diameter.

Figure 1B:
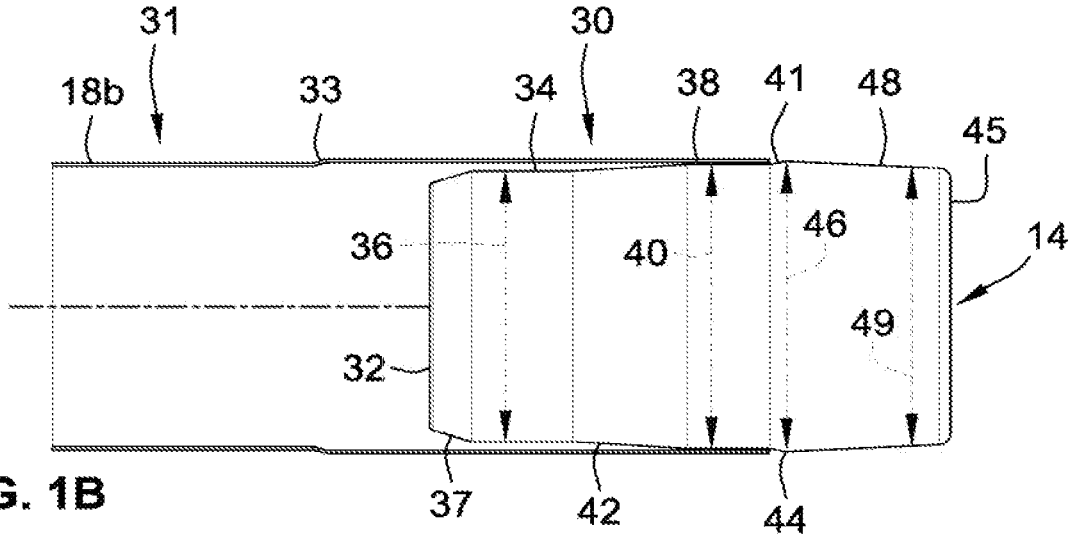
FIG. 1B is a side view of an expansion operation subsequent to the expansion operation of FIG. 1A using a second expansion tool.
Figure 1C:
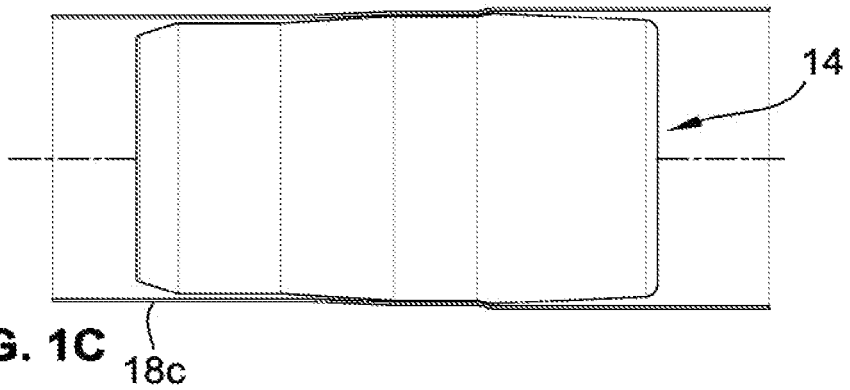
FIG. 1C is a side view of the expansion operation of FIG. 1B after the second expansion tool has been forced further into the interior of the container.

FIGS. 1A-1C illustrate one non-limiting example of a method and apparatus for expanding a container, according to one non-limiting embodiment. In the illustrated embodiments discussed herein, the expansion process forms a container having a contoured sidewall surface, wherein an unexpanded portion of the container is narrower than an expanded portion of the container.

Figure 3A:
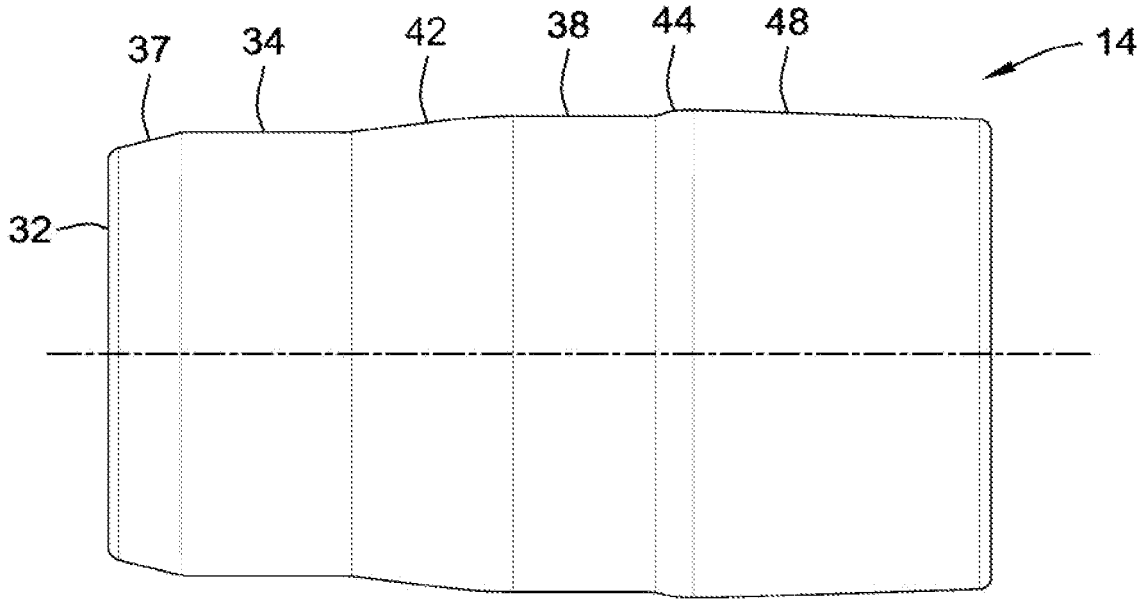
FIG. 3A is a side, close-up view of the second expansion tool of FIGS. 1B, 1C.
Figure 3B:
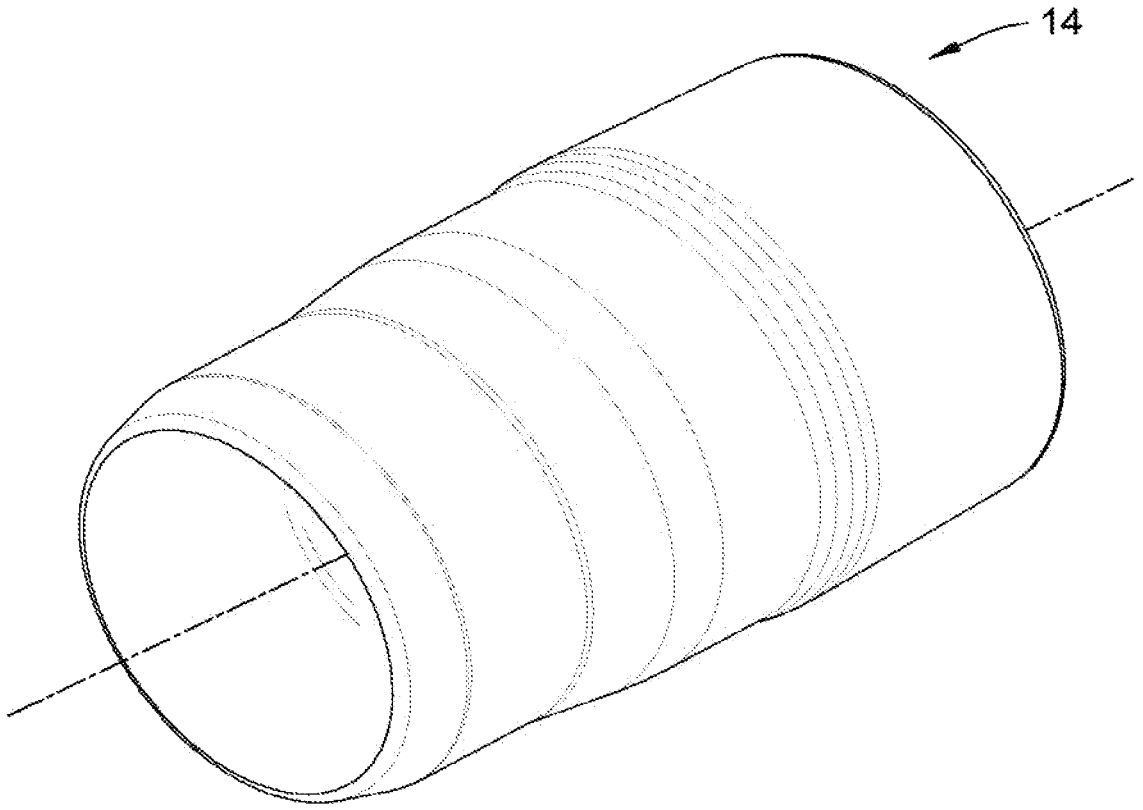
FIG. 3B is a perspective side view of the second expansion tool of FIGS. 1B, 1C, and 3A.

The expansion process shown in FIGS. 1A-1C includes a first expansion tool 12 (FIG. 1A) and a second expansion tool 14 (FIGS. 1B, 1C, 3A, 3B). FIG. 3A shows a close-up view and FIG. 3B shows a perspective side view of the second expansion tool 14 of FIGS. 1B, 1C. As shown in FIG. 1A, a first, leading end 16 of the first expansion tool 12 is axially forced a predetermined distance into an open end of a container 18. Beginning at the first end, the first expansion tool 12 includes a lead-in portion 19, a pilot portion 20, an expansion portion 22, and, optionally, a relief portion 23. The lead-in portion 19 is generally sloped, extends generally outwardly from the first end 16 of the first expansion tool 12, and facilitates insertion of the first expansion tool 12 into the container 18. The pilot portion 20 has a pilot diameter 24 generally equal to an initial diameter 26 of the container 18. As such, the pilot portion 20 fits generally snugly therein, thereby axially guiding the container 18 and maintaining it in a generally central position with respect to the first expansion tool 12. The expansion portion 22 has an expansion diameter 28 greater than the pilot diameter 24 and defines the diameter to which the container is expanded. A generally inclined land 29 bridges the pilot portion 20 and the expansion portion 22. The relief portion 23 may have a relief diameter 39 smaller than the expansion diameter 28 of the expansion portion 22. The expansion portion 22 forms a partially expanded container having an expanded portion 30 and a generally unexpanded portion 31.

When the first expansion tool 12 is inserted a predetermined distance into the interior of the container in the direction of Arrow A, the expansion portion 22 contacts and expands the interior sidewall of container. The expansion diameter 28 of the expansion portion 22 is greater than the initial diameter 26 of the container 18, thereby dictating and forming the first expanded diameter (diameter 40 of FIG. 1B) of the container 18*b* after the first expansion operation of FIG. 1A.

As shown in FIG. 1B, the land 29 of the first expansion tool 12 leaves a protruding "bump" or deformity 33 in the sidewall of the container 18*b*. The deformity has a shape generally corresponding with the shape of the land 29.

Following the first expansion process of FIG. 1A, a first end 32 of a second expansion tool 14 is inserted a predetermined distance into the open end of the container 18*b*, as shown in FIG. 1B. The second expansion tool 14 includes a lead-in portion 37, a first pilot portion 34 having a first pilot diameter 36, a second pilot portion 38 having a second pilot diameter 40, and a forming portion 42 bridging the first and second pilot portions 34, 38. The first pilot diameter 36 of the first pilot portion 34 may be generally the same as the initial diameter 26 of the container (and, as such, the pilot diameter 24 of the pilot portion 20 of the first expansion tool 12). The first and second pilot portions 34, 38 are generally parallel to one another. The second pilot diameter 40 of the second pilot portion 38 is larger than the first pilot diameter 36 of the first pilot portion 34. The second pilot portion 38 has generally the same diameter as the expansion portion 22 of the first expansion tool 12 (e.g., the diameter of the expanded portion of the container 18*b*) such that second pilot portion 38 fits therein, thereby guiding the container 18*b* and maintaining it in a generally central position. The forming portion 42 is generally sloped and bridges the first and second pilot portions 34, 38. An expansion portion 44 extends from the second pilot portion 38 toward a second, rear end 45 of the second expansion tool 14. The expansion portion 44 has an expansion diameter 46 greater than the second pilot diameter 40. A generally inclined land 41 bridges the second pilot portion 38 and the expansion portion 44. The second expansion tool 14 may also include a relief portion 48 positioned at or near the rear end 45 of the second expansion tool 14. The relief portion 48 may have a relief diameter 49 smaller than the expansion diameter 46 of the expansion portion 44.

The second pilot diameter 40 is generally equal to the diameter 26 of the expanded portion 30 of the container 18*b*. As such, the second pilot portion 38 fits generally snugly therein, thereby axially guiding the container 18*b* and maintaining it in a generally central position with respect to the second expansion tool 38. Once the second expansion tool 14 has been inserted a predetermined distance into the container 18*b* at the end of an expansion stroke, the first pilot portion 34 contacts the downstream, generally unexpanded portion 31 of the container 18*b*. During this axial movement, the forming portion 42 contacts the deformity 33 formed during the first expansion (see FIG. 1A), resulting in the deformity 33 being smoothened into a sloped geometry generally corresponding with that of the forming portion 42. Simultaneously, the expansion portion 44, which has an expansion diameter 46 greater than the diameter 40 of the expanded portion 30 resulting from the first expansion process of FIG. 1A, further expands the expanded portion 30 of the container 18*b*.

In one embodiment, the second expansion tool 14 may be inserted generally the same predetermined distance relative to the distal end 50 of the container 18*c* (see FIG. 2C) as the first expansion tool 12. In this embodiment, the axial distance from the first end 16 of the first expansion tool 12 to the land 29 is generally the same as the axial distance from the first end 32 of the second expansion tool 14 to the forming portion 42, thereby facilitating smoothening of the deformity 38 formed by the first expansion tool 12 during the previous expansion process.

It is contemplated that the second expansion tool 14 may be inserted a greater or a smaller distance relative to the distal end 50 of the container 18*c* than the first expansion tool 12. In such embodiments, the axial distance from the first end 32 of the second expansion tool 14 to the forming portion 42 should be such that the forming portion 42 may contact and smoothen the deformity 38 formed by the first expansion tool 12 in the previous expansion process. For example, if the second expansion tool 14 is to be inserted a smaller distance into the container 18*c* (farther from the distal end 50 of the container), the forming portion 42 should be positioned a shorter distance from the first end 32 of the second expansion tool 14.

As described above, a subsequent expansion operation utilizes an expansion tool that includes a secondary pilot portion (e.g., second pilot portion 38 of FIG. 1B) that fits the expanded container diameter formed during the previous expansion operation (e.g., expansion diameter 28 of FIG. 1A) and guides the container until the original pilot diameter (e.g., first pilot diameter 36 of FIG. 1B) takes control at the end of the expansion stroke. The second pilot portion described herein also assists in preventing blending and/or smoothening of the previous expansion since the expansion portion is positioned behind the second pilot portion (relative to the direction in which the expansion tool is inserted into the container, e.g., Arrow A of FIG. 1A).

During the expansion operation, the container is located by the second pilot portion and expanded by the geometry of the expansion portion located behind the second pilot portion. As the expansion tool nears the end of the expansion stroke, the bump or deformity created during the prior expansion operation is smoothened by the forming portion. Thus, the expansion operations and tools of the embodiments described herein perform two operations at once—smoothening and further expanding.

This may be repeated throughout the remaining expansion process until the desired container shape is achieved. As such, the next expansion operation may repeat the process of blending/smoothing and expanding.

It is contemplated that any number of expansion operations utilizing a respective number of expansion tools may be used to form a desired shape of a final container. Optionally, at the end of an expansion operation, a final expander (see final expander 102 of FIG. 2E) may be inserted into the container to further blend or smoothen any unwanted bumps or deformities resulting from prior expansions.

The ratio of expanding and blending operations may be varied based on the desired shape of the finished container. For example, the container may be subjected to multiple expansion operations (thereby creating multiple deformities or bumps) before being subjected to smoothening (or multiple smoothening processes).

According to one embodiment, an expansion mechanism for expanding an article includes a first expansion tool and a second expansion tool. The first expansion tool includes a first lead-in portion extending outwardly from a first end of the first expansion tool and a first pilot portion extending from the first lead-in portion. The first pilot portion has a first diameter. The first expansion tool further includes a first expansion portion having a second diameter that is larger than the first diameter. The first expansion tool further includes a first land bridging the first pilot portion and the first expansion portion. The second expansion tool includes a second lead-in portion extending outwardly from a first end of the second expansion tool and a second pilot portion extending from the second lead-in portion. The second pilot portion has a third diameter. The second expansion tool further includes a third pilot portion being generally parallel to the second pilot portion. The third pilot portion has a fourth diameter that is larger than the third diameter. The second expansion tool further includes a forming portion bridging the second pilot portion and the third pilot portion and a second expansion portion having a fifth diameter. The fifth diameter is larger than the third diameter. The second expansion tool further includes a second land bridging the forming portion and the second expansion portion. The axial distance from the first end of the first expansion tool to the first land is generally the same as the axial distance from the first end of the second expansion tool to the forming portion, the second expansion tool being configured to be used subsequent to the first expansion tool.

Figures 2A, 2B, 2C, 2D, 2E:
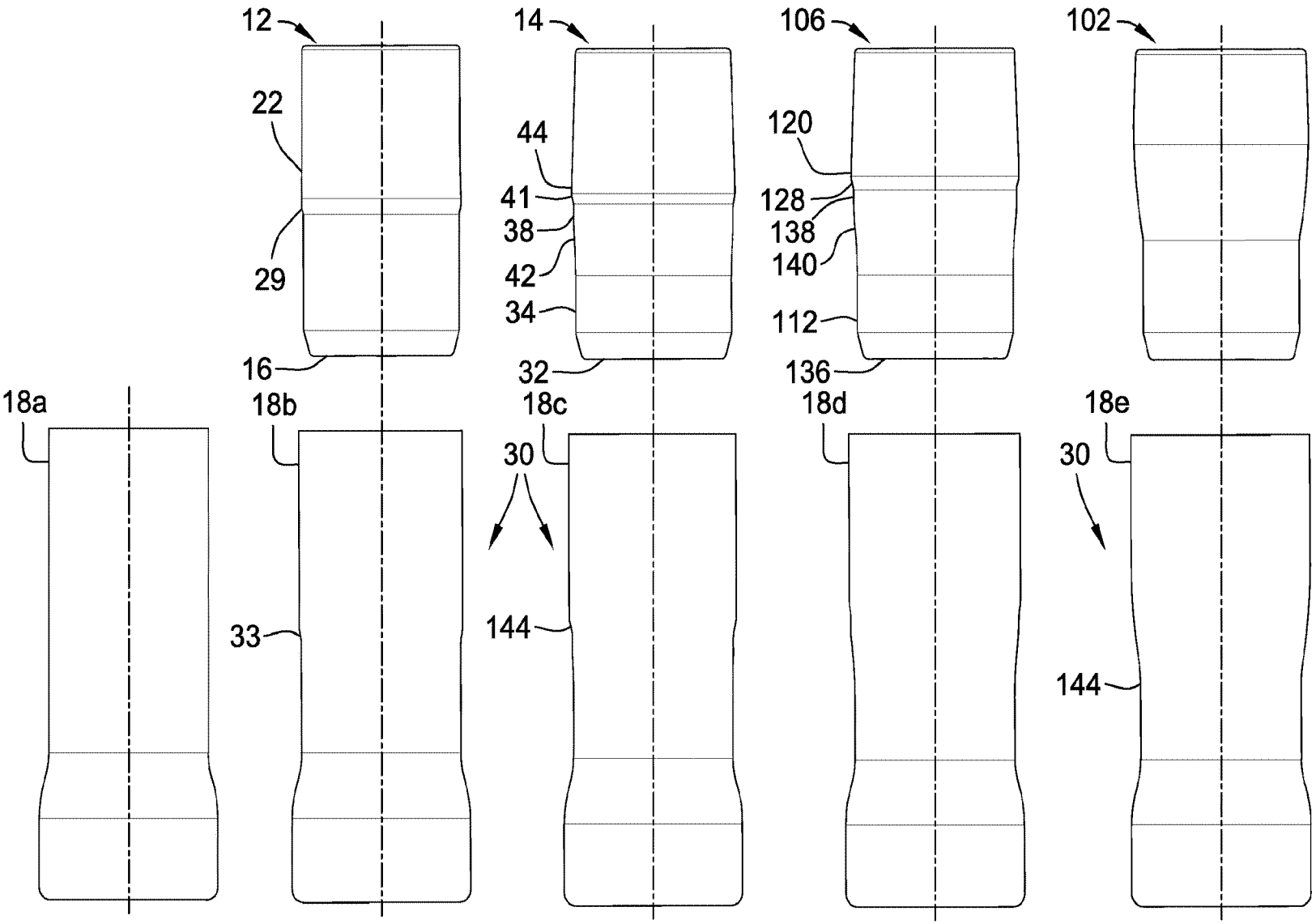
FIGS. 2A-2E are side views of expansion tools that may be used according to one expansion process and containers resulting from expansion processes utilizing the respective expansion tools.

The process shown in FIGS. 1A-1C may be repeated with other or additional expansion tools (see FIGS. 2A-2E) to obtain a desired shape of the resulting container (e.g., container 18E of FIG. 2E). FIGS. 2A-2E show exemplary expansion tools and respective expanded containers resulting from the insertion of the expansion tools therein according to one embodiment. Referring to FIG. 2A, for example, a starting cylinder or container 18*a* is shown prior to expansion, e.g., prior to being transferred from a first transfer star wheel 202 to an expansion (forming) turret 210 (see FIG. 5). In FIG. 2B, the container 18*b* has undergone an expansion process using the first expansion tool 12 of FIG. 1A during which the first expansion tool 12 is inserted into and removed from the initial container 18*a* of FIG. 2A. Likewise, FIG. 2C shows the second expansion tool 14 of FIGS. 1B-1C and the container 18*c* (see FIG. 1C) resulting from the second expansion (see FIG. 1C) during which the second expansion tool 14 is inserted into and withdrawn from the container 18*b* of FIG. 2B. FIG. 2D shows an optional subsequent third expansion tool 106 and the container 18*d* resulting from a third expansion (not shown) during which the third expansion tool 106 may be inserted into and withdrawn from the container 18*c* of FIG. 2C. The final expander tool 102 may be inserted into the container 18*d* to further blend or smoothen any unwanted bumps or deformities resulting from prior expansions, thereby creating the final container 18*e* having the desired shape.

As shown in the illustrated embodiments of FIGS. 2A-2E, the diameter of the expansion portion 22, 44, 120 of each expansion tool 12, 14, 106 is larger than that used in the preceding expansion operation such the container is expanded in an incremental, stepwise manner, thereby minimizing stresses applied to the container material. Put another way, each expansion tool of each expansion operation generally functions to further expand and shape the container formed by the preceding expansion tool. It is contemplated that any number of expansion tools/expansion operations may be used during the expansion process to form the desired container shape.

Notably, the second and third expansion tools 14 and 106 include a first pilot portion 34, 112 and a second pilot portion 38, 138 that are substantially parallel to one another and to the main sidewalls of the container. The first pilot portion 34, 112 has generally the same diameter as the initial diameter 26 of the container 18*a* (e.g., the unexpanded portion 114 of the final container 18*e*) such that, when the first pilot portion 34, 112 is inserted into the container, it guides, but does not further expand the container near the end of the expansion stroke. The second pilot portion 38, 138 has generally the same diameter as the expanded portion 30 formed during the preceding process step by the preceding expansion tool. As such, the container is maintained in a generally centralized position throughout the expansion process.

In the embodiment of FIGS. 2A-2E, each of the expansion tools 12, 14, 106, 102 is inserted the same axial distance into the container 18. As such, as shown in FIGS. 2B-2D, the expansion portion 44, 120 and the land 41, 128 of the second and third expansion tools 14, 106 are positioned a greater distance from the front end 32, 136 of the expansion tools 14, 106 relative to the preceding expansion tool 12, 14. Accordingly, the forming portion 42, 140 of each expansion tool 14, 106 is positioned a greater distance from the front end 32, 126 than that of a preceding expansion tool 12, 14. As such, the bump or deformation 33, 144 formed by the preceding expansion tool 12, 14 may be contacted and smoothened by the forming portion 42, 140 of the subsequent expansion tool 14, 106, and the expansion portion 44, 120 of the subsequent expansion tool 14, 106 (which has a greater diameter than that of the preceding expansion tool 12, 14) may continue to expand the desired portion of the container.

The embodiments described herein provide various advantages over conventional expansion processes and apparatus. For example, in conventional expansion processes and apparatus, the pilot portion of a subsequent expansion tool does not provide any benefit to a previously partially expanded container until the pilot portion comes into contact with the interior of the container that has not been expanded. In the embodiments described herein, on the other hand, the second pilot portion positioned just prior to the expansion portion provides for constant piloting and guidance of the container such that the container is not positioned off center with respect to the expansion tool during the expansion operation. Thus, improved concentricity is achieved between expansion operations, especially for deep forming in which the forming process is performed over generally the entire length of the container (or from as close to the bottom as possible up through or near the top of the container). As such, the container sidewall material is less likely to undesirably thin or thicken, which may lessen defects or splitting of the material. Moreover, the resulting surface of the expanded container is generally smoother and includes fewer (if any) visual defects. The embodiments described herein also provide the ability to use an expansion portion having a smaller diameter compared with a larger finishing diameter, which may allow for a larger rate of expansion that applies less stress to the container material.

Figure 4A:
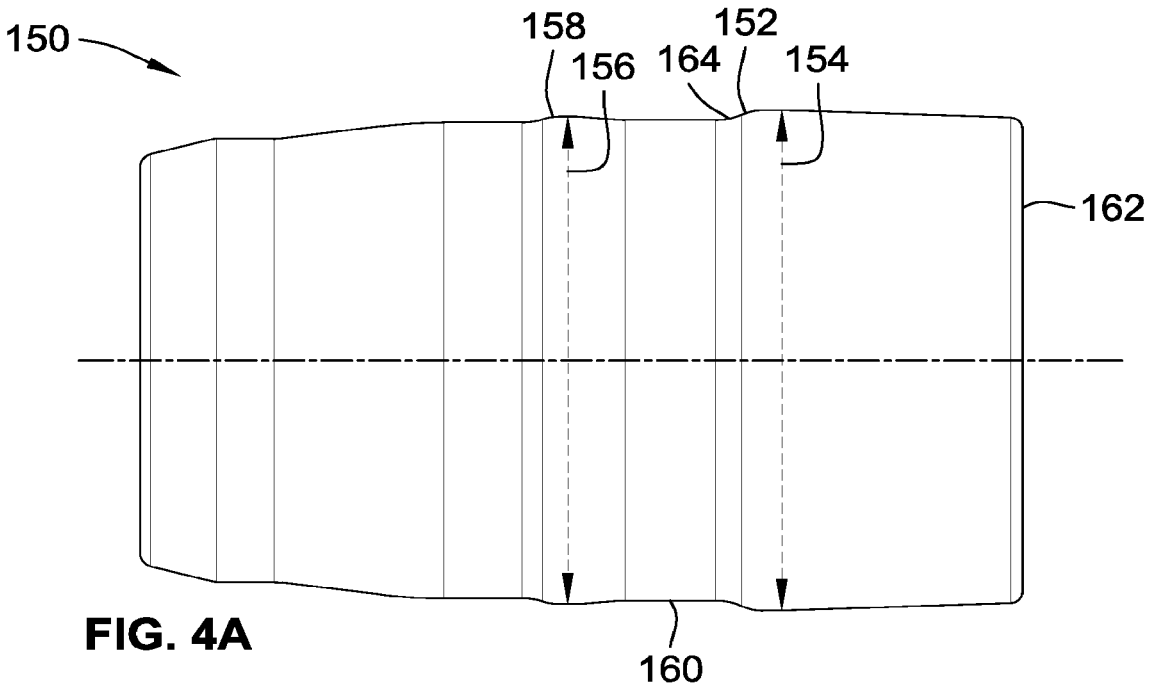
FIG. 4A is a side view of an expansion tool according to another embodiment.
Figure 4B:
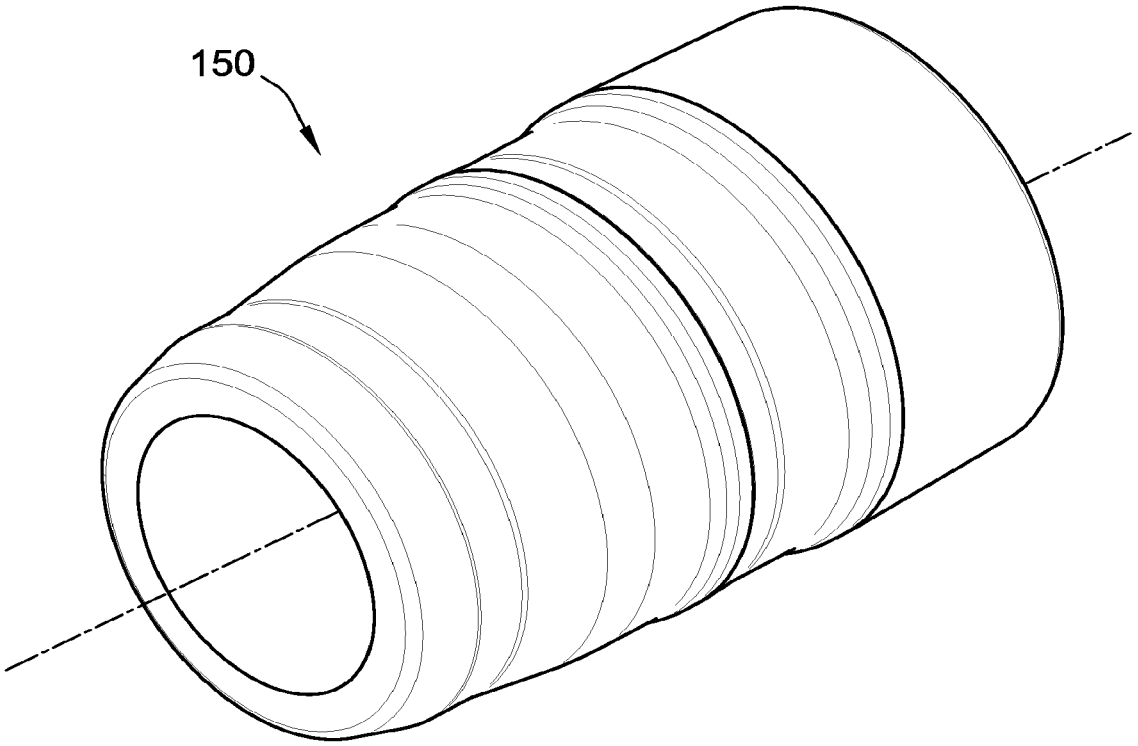
FIG. 4B is a perspective side view of the expansion tool of FIG. 4A.

FIGS. 4A, 4B illustrate a double-land expansion tool 200 according to another embodiment. The double-land expansion tool 200 of FIGS. 4A, 4B is generally similar to those described above. The double-land expansion tool 200, however, further includes a second expansion portion 152 having a diameter 154 larger than a diameter 156 of a first expansion portion 158. In the illustrated embodiment, the double-land expansion tool 200 includes a relief portion 160 extending from the first expansion portion 158 toward a rear/non-leading, second end 162 of the expansion tool 200 and an inclined land portion 164 bridging the relief portion 160 and the second expansion portion 164. The double-land expansion tool 200 essentially functions as two expansion tools combined into one. As such, the double-land expansion tool 200 may provide greater expansion rates using a single forming process (instead of two). It is contemplated that the expansion tools in accordance with the embodiments described herein may have any suitable number of expansion portions. It is further contemplated that the container may undergo any suitable number of other operations before, in between, and/or after expansion operations.

The articles described herein may be processed through any number of stages, one or more of which may be a diameter expansion stage. When all process/forming stages are complete, the article is discharged from the machine. The expansion mechanisms described herein may be part of a machine line such as a recirculated machine line or any other type of machine line.

An expansion mechanism may be a separate machine, or the expansion mechanism may be one machine in a machine line. One example of a machine line that may be used with the embodiments described herein is described in U.S. Pat. No. 7,963,139, which is hereby incorporated by reference in its entirety. Referring to the machine line 250 of FIG. 5, for example, an article or container is first fed into a first machine to fill stations in a turret/star wheel. Each star wheel may have any number of stations to hold articles for processing or transfer. For example, a star wheel may have six, eight, or ten stations to hold six, eight, or ten articles, respectively. It will be recognized that the star wheel is capable of having one station to any suitable number of stations.

According to one embodiment, an expansion process includes feeding an article into a continuously rotating turret, as disclosed in U.S. Pat. No. 7,963,139. The article is loaded into a forming station, and an expansion tool is inserted into an open end of the article. The expanding tool is withdrawn, and the article is transferred to another turret, discharge track, or to another apparatus. As described in detail above, a portion of the expanding tool has a diameter greater than the diameter of at least a portion of the article.

Figure 5:
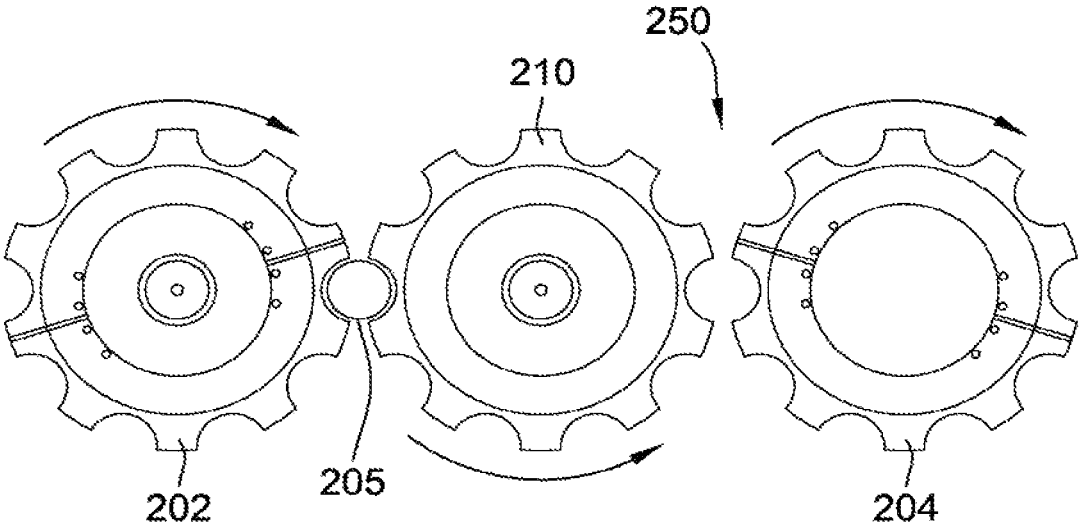
FIG. 5 is a schematic of an exemplary machine line including an infeed turret, a forming/process turret, and a discharge or secondary turret.
Figure 6:
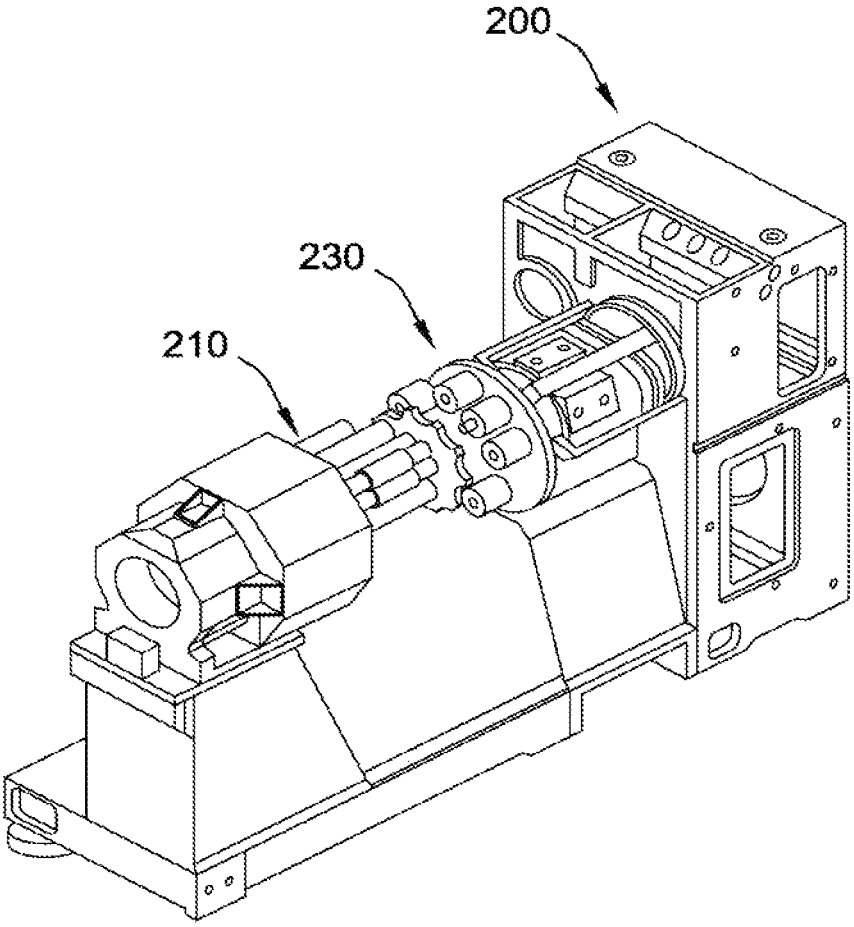
FIG. 6 is a perspective view of the machine line of FIG. 5 with a can expansion apparatus according to one embodiment.
Figure 7:
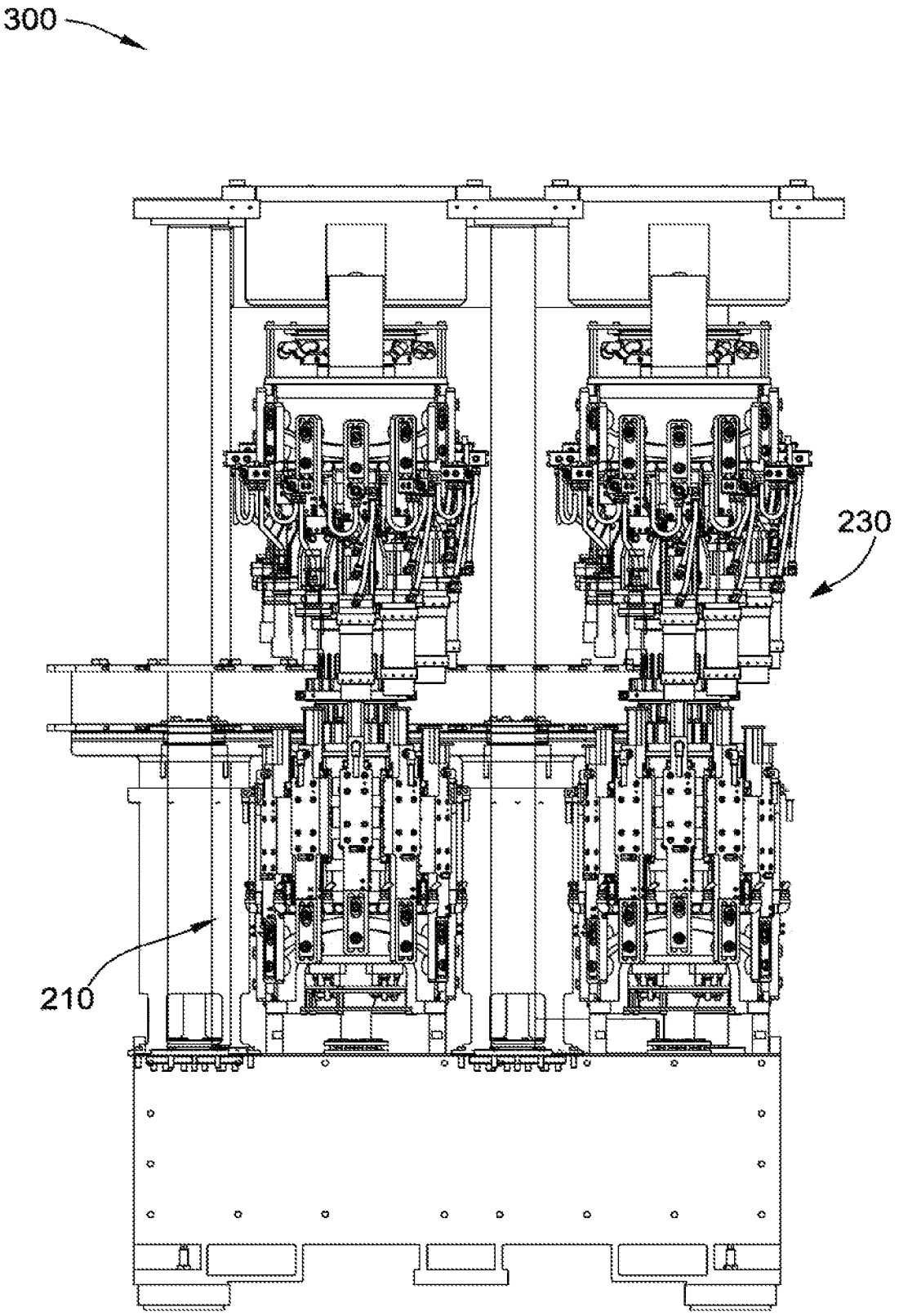
FIG. 7 is a front-view of the machine line of FIG. 5 with a can forming apparatus according to another embodiment.

FIGS. 6 and 7 illustrate exemplary embodiments of a container (e.g., can) expansion apparatus and a forming apparatus. FIG. 6 generally illustrates a necking apparatus 200, and FIG. 7 generally illustrates a shaping apparatus 300 (described in more detail, respectively, in U.S. Pat. No. 7,963,139 and U.S. Patent Application Publication No. 2015/0082849, both of which are incorporated by reference herein). Cans 205, according to an embodiment, are fed into a continuously rotating turret 210 either from an infeed track or from a preceding process turret 202, which may be part of a machine line 250 (see FIG. 5). FIG. 5 illustrates an infeed turret star wheel 202 passing a can 205 to the continuously rotating turret star wheel 210 of the can expansion process. While the turret 210 is rotating with the can 205 loaded into a forming station therein, an expansion tool 230 (e.g., expansion tool 14 or 106 of FIGS. 2C, 2D) including a diameter larger than the existing (initial) can diameter will be inserted into the can 205 and then withdrawn. The can 205 is then transferred from the turret 210 onto another process turret 204 or a discharge track, in the direction illustrated by the arrows in FIG. 5.

Referring back to FIG. 5, the apparatus, according to an embodiment, comprises an infeed vacuum transfer wheel 202, the forming turret 210, and a discharge vacuum transfer wheel 204. Both the infeed and discharge vacuum transfer wheels 202, 204 are similar in design and function. The infeed wheel 202 loads the can 205 into the forming turret 210 and the discharge wheel 204 unloads the can 205 from the forming turret 210.

The cans 205 may be held in position on this first transfer star wheel using a pneumatic pressure differential or "suction" as it will be referred to.

The cans are then passed from the first transfer star wheel to a first turret star wheel and enter into the can expansion forming process on the can expansion machine. While the invention is not so limited, embodiments of the invention may comprise expansion machines constructed as modules. The use of can expansion modules allows for the machine line 250 to be assembled/changed to provide as many can expansion stages as is required and to allow for the addition of additional stages such as flanging, necking, trimming, curling, threading, and/or base reforming/reprofiling, which may be added/removed as desired.

While the invention is susceptible to various modifications and alternative forms, specific embodiments and methods thereof have been shown by way of example in the drawings and are described in detail herein. It should be understood, however, that it is not intended to limit the invention to the particular forms or methods disclosed, but, to the contrary, the intention is to cover all modifications, equivalents and alternatives falling within the spirit and scope of the invention.

What I claim is:

1. An expansion tool for expanding an article, the expansion tool comprising:

a first pilot portion having a first diameter;

a second pilot portion being generally parallel with the first pilot portion, the second pilot portion having a second diameter larger than the first diameter;

a forming portion bridging the first pilot portion and the second pilot portion, the forming portion being generally sloped;

a first expansion portion extending from the second pilot portion, the first expansion portion having a third diameter larger than the second diameter;

a second expansion portion having a fourth diameter larger than the third diameter;

a sloped relief portion extending from the first expansion portion, the relief portion having a fifth diameter smaller than the third diameter; and a second sloped relief portion extending from the second expansion portion, the second relief portion having a sixth diameter smaller than the fourth diameter.

2. The expansion tool of claim 1, wherein the expansion tool is for expanding an article to form a contoured outer surface.

3. The expansion tool of claim 1, further comprising a lead-in portion extending from a first extreme end of the expansion tool, wherein the lead-in portion is generally sloped.

4. The expansion tool of claim 1, further comprising a generally inclined land bridging the relief portion and the second expansion portion.

5. An expansion mechanism for expanding an article, the expansion mechanism comprising:

a first expansion tool including a first lead-in portion extending from a first end of the first expansion tool, a first pilot portion extending from the first lead-in portion, the first pilot portion having a first diameter, a first expansion portion, the first expansion portion having a second diameter, the second diameter being larger than the first diameter, and a first land bridging the first pilot portion and the first expansion portion and configured to form a deformity in a sidewall of the article; and a second expansion tool configured to be used subsequent to the first expansion tool, the second expansion tool including a second lead-in portion extending from a first end of the second expansion tool, a second pilot portion extending from the second lead-in portion, the second pilot portion having a third diameter, the third diameter being generally equal to the first diameter, a third pilot portion being generally parallel to the second pilot portion, the third pilot portion having a fourth diameter, the fourth diameter being generally equal to the second diameter, a forming portion bridging the second pilot portion and the third pilot portion, a second expansion portion having a fifth diameter, the fifth diameter being larger than the third diameter, and a second land bridging the third pilot portion and the second expansion portion, wherein the axial distance from the first end of the second expansion tool and the forming portion is greater than the axial distance from the first end of the first expansion tool and the first land such that the forming portion is configured to contact and smoothen the deformity formed by the first land of the first expansion tool.

6. The expansion mechanism of claim 5, wherein the first diameter is generally equal to an initial diameter of the article.

7. The expansion mechanism of claim 5, wherein the first and second lead-in portions are generally sloped.

8. The expansion mechanism of claim 5, wherein the forming portion is generally sloped.

9. A method of expanding an article, the method comprising:

inserting a first end of a first expansion tool into an open end of the article, the first expansion tool having a first pilot portion followed by a first expansion portion, the first pilot portion having a first diameter generally equal to an initial diameter of the article, the first expansion portion having a second diameter, the second diameter being greater than the first diameter, the first expansion portion forming a partially expanded article having an expanded portion, the first expansion portion forming at least one deformity in the expanded portion of the article; and removing the first expansion tool from the open end of the partially expanded container;

inserting a first end of a second expansion tool into the open end of the partially expanded article, the second expansion tool including a second pilot portion having a third diameter, a first forming portion extending from the second pilot portion, the first forming portion being generally sloped, the distance between the first end of the second expansion tool and the first forming portion being greater than the distance between the first end of the first expansion tool and the first expansion portion such that the first forming portion smoothens the at least one deformity formed in the expanded portion of the article.

10. The method of claim 9, wherein the first expansion tool includes a land bridging the first pilot portion and the first expansion portion, the at least one deformity having generally the same shape as the land.

11. The method of claim 9, wherein the second expansion tool further includes a third pilot portion, the first forming portion bridging the second and third pilot portions.

12. The method of claim 9, wherein the second expansion tool further includes a second expansion portion extending toward a second opposing end of the second expansion tool, the second expansion portion having a diameter greater than a diameter of the first forming portion.

13. The method of claim 12, wherein the second expansion portion forms a second at least one deformity in the expanded portion of the article, the method further comprising, after inserting the second expansion tool, inserting a first end of a third expansion tool into the open end of the article, the third expansion tool including a second, generally sloped forming portion, at least a portion of the second forming portion having a diameter greater than the diameter of the second expansion portion such that the second forming portion smoothens the second at least one deformity.

14. The method of claim 13, wherein the second expansion tool further includes a third pilot portion, the first forming portion bridging the second and third pilot portions and wherein the second expansion tool includes a second land bridging the third pilot portion and the second expansion portion, the second at least one deformity having generally the same shape as the second land.

15. The method of claim 14, wherein the distance between the first end of the third expansion tool and the second forming portion is generally less than the distance between the first end of the second expansion tool and the second expansion portion.

16. The method of claim 13, wherein the second expansion tool and the third expansion tool are inserted generally the same distance into the article.

* * * * *